US011129462B2

(12) United States Patent
Spinelli et al.

(10) Patent No.: US 11,129,462 B2
(45) Date of Patent: Sep. 28, 2021

(54) CONTAINER WITH A BRUSH APPLICATOR

(71) Applicants: Franco Spinelli, Henderson, NV (US); Leonard Salati, Bronx, NY (US)

(72) Inventors: Franco Spinelli, Henderson, NV (US); Leonard Salati, Bronx, NY (US)

( * ) Notice: Subject to any disclaimer, the term of this patent is extended or adjusted under 35 U.S.C. 154(b) by 192 days.

(21) Appl. No.: 16/543,327

(22) Filed: Aug. 16, 2019

(65) Prior Publication Data

US 2020/0060408 A1 Feb. 27, 2020

Related U.S. Application Data

(60) Provisional application No. 62/721,395, filed on Aug. 22, 2018.

(51) Int. Cl.
*A45D 34/04* (2006.01)
*A45D 29/00* (2006.01)

(52) U.S. Cl.
CPC ..... *A45D 34/045* (2013.01); *A45D 29/00* (2013.01); *A45D 34/043* (2013.01)

(58) Field of Classification Search
CPC .. A45D 34/045; A45D 34/043; A45D 40/265; A45D 40/264; A45D 34/042; A45D 34/048; A45D 40/262
See application file for complete search history.

(56) References Cited

U.S. PATENT DOCUMENTS 5,690,441 A * 11/1997 McManus ..... A46B 11/0006 401/122
6,164,857 A * 12/2000 Wolfarth-Brooks ..... A45D 34/045 401/126
6,789,970 B1 * 9/2004 Shearon ..... A46B 7/023 401/127
2003/0147685 A1 * 8/2003 Epli ..... A45D 34/045 401/127

FOREIGN PATENT DOCUMENTS

DE 29702226 U1 * 8/1997

* cited by examiner

*Primary Examiner* — Daniel J Colilla
(74) *Attorney, Agent, or Firm* — Edmond DeFrank

(57) ABSTRACT

A combination container and applicator for a fluid includes a container having a top end open to an internal volume that has a tapered floor. A cap adapted to engage the top end has a brush applicator projecting downwardly therefrom into the internal volume of the container. The brush applicator includes a brush and a sheath, the brush extending beyond the sheath when the brush applicator is in the extended position, and the brush retracting fully inside the sheath when the brush applicator is in the retracted position. The cap includes a brush extension mechanism that is adapted to move the brush applicator between a retracted portion, such that the brush and brush applicator do not contact the floor of the container when the cap is engaged with the container, and an extended position such that the brush is able to reach all areas of the floor of the container.

1 Claim, 6 Drawing Sheets

CONTAINER WITH A BRUSH APPLICATOR

STATEMENT REGARDING FEDERALLY SPONSORED RESEARCH AND DEVELOPMENT

Not Applicable.

FIELD OF THE INVENTION

This invention relates to containers, and more particularly to a container having a built-in brush applicator.

DISCUSSION OF RELATED ART

Nail polish containers that include brushes, and other containers that include applicators, are notorious for not providing a brush or applicator long enough to extend to all areas of an internal volume of the container. As a result, fluid such as nail polish or paint, is wasted when it cannot be accessed.

Therefore, there is a need for a combination container and applicator that provides an extendible brush that can access all areas of a floor of the container. Such a needed invention would be able to retract the brush to preserve the shape of the brush and prevent damage of the brush bristles being splayed against the floor of the container for prolonged periods of time. Such a needed device would allow the brush to access all areas of the floor of the container even when a cap and brush of the container are not fully engaged with the container. The present invention accomplishes these objectives.

SUMMARY OF THE INVENTION

The present device is a combination container and applicator for a fluid, such as nail polish, paint, or any other fluid that is typically applied with a brush or tool. A container has a top end open to an internal volume that has a tapered floor for pooling the fluid in a central location on the floor opposite the open top end.

A cap is adapted to engage the open top end of the container in a sealed and closed configuration. The cap has a brush applicator projecting downwardly therefrom into the internal volume of the container when the cap is in the sealed and closed configuration. The brush applicator preferably includes a brush and a sheath, the brush extending beyond the sheath when the brush applicator is in the extended position, and the brush retracting fully inside the sheath when the brush applicator is in the retracted position.

The brush applicator and the cap may be selectively removed from the container by unscrewing (or otherwise disengaging) the cap from the top end of the container and pulling the cap away from the container. Typically, the fluid retained by the brush is then applied to a workpiece, such as a person's fingernails, an object to be painted or cleaned, or the like. When more of the fluid is required, the brush applicator is inserted into the top end of the container so that the brush can be swept around the floor of the container manually to collect more fluid from all parts of the floor.

The cap includes a brush extension mechanism that is adapted to move the brush applicator between a retracted portion, such that the brush and brush applicator do not contact the floor of the container when the cap is in the sealed and closed configuration, and an extended position such that the brush is able to reach all areas of the floor of the container when the cap is contacting the open top end of the container but is not necessarily in the sealed and closed configuration.

The brush extension mechanism further includes an actuator projecting through the cap that is adapted to toggle the brush applicator between the extended position and the retracted position. The brush extension mechanism further includes a cam body fixed with the brush and the brush actuator, a plunger fixed with the actuator, at least one stop member fixed within the brush extension mechanism and fixed immovably with respect to the cap, and a spring urging the cam body upwardly against the plunger and the at least one stop member when in the retracted position and when the at least one stop member is fully seated in a long stop member channel of the cam body. The actuator causes the plunger to press against the cam body and spring until the cam body passes the at least one stop member. The cam body and plunger each have multiple angled and abutting surfaces that cause the cam body to rotate upon passing the at least one stop member at the urging of the spring. As such, the cam body advances so that the at least one stop member can engage a short stop member channel of the cam body to place the cam body, the brush applicator, and the brush in the extended position. The next press of the actuator causes the plunger to press downwardly again on the cam body so that it clears the at least one stop member and advances so that the long stop member channel of the cam body again becomes engaged with the at least one stop member in the retracted position. Each successive press of the actuator causes the brush applicator, brush, and cam body to toggle between the retracted and extended positions.

The brush extension mechanism described above has a one-to-one ratio of movement between the brush and the actuator. However, other brush extension mechanisms could be utilized that provide for a ratio greater than of movement of the brush with respect to the actuator, such as a 2:1 ratio of movement of the brush with respect to the actuator.

The present invention is a combination container and applicator that provides an extendible brush that can access all areas of a floor of the container. The present invention allows the user to selectively retract the brush to preserve the shape of the brush and prevent damage of the brush bristles being splayed against the floor of the container for prolonged periods of time. The present device allows the brush to access all areas of the floor of the container even when a cap and brush of the container are not fully engaged with the container. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above." "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
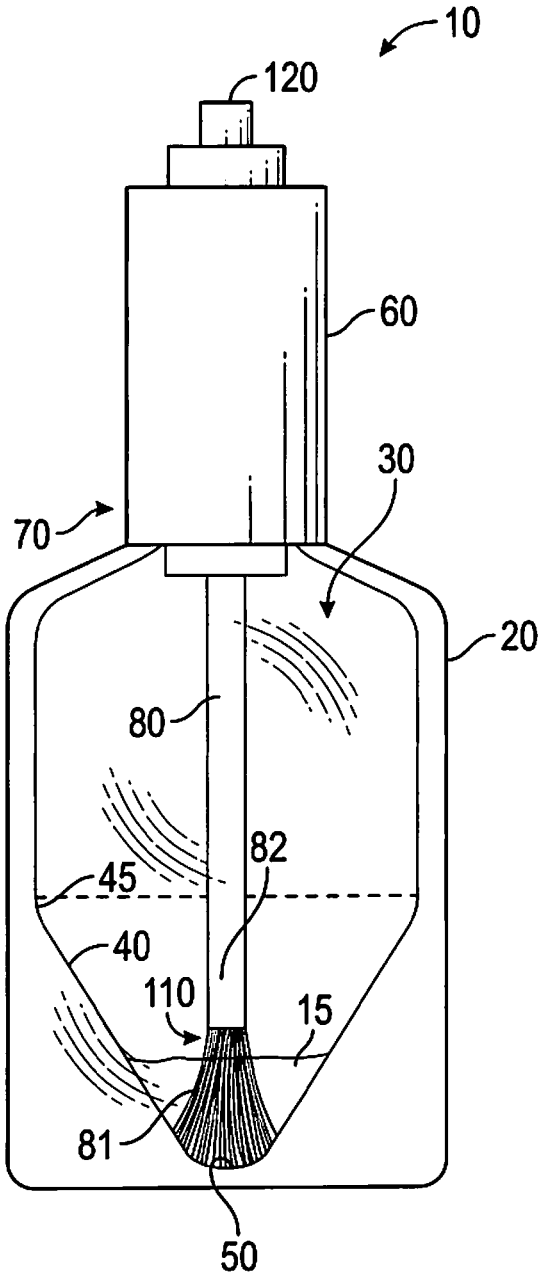
FIG. 1 is a front elevational view of the invention, partially broken away to reveal an interior volume within a container and a cap having a brush applicator, the brush in an extended position.
Figure 2:
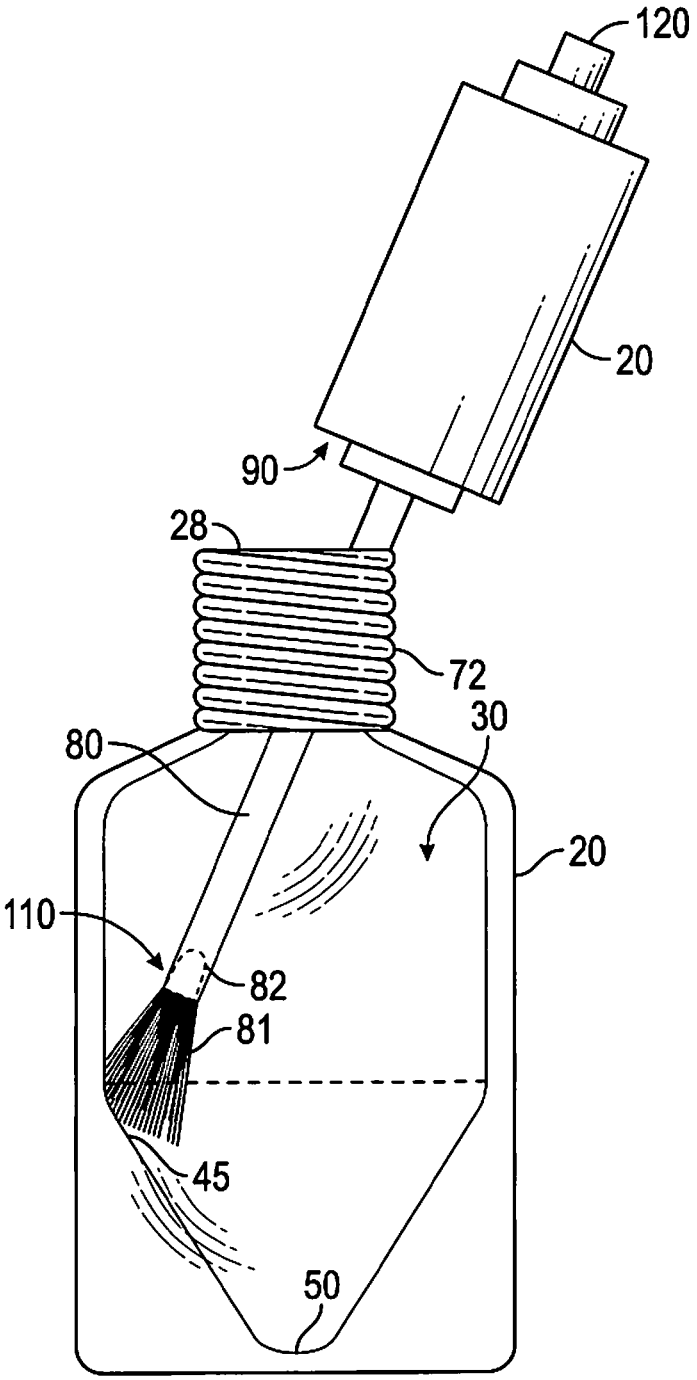
FIG. 2 is a front elevational view of the invention, partially broken away to illustrate the cap removed from the container and the brush accessing all areas of a floor of the container.
Figure 3A:
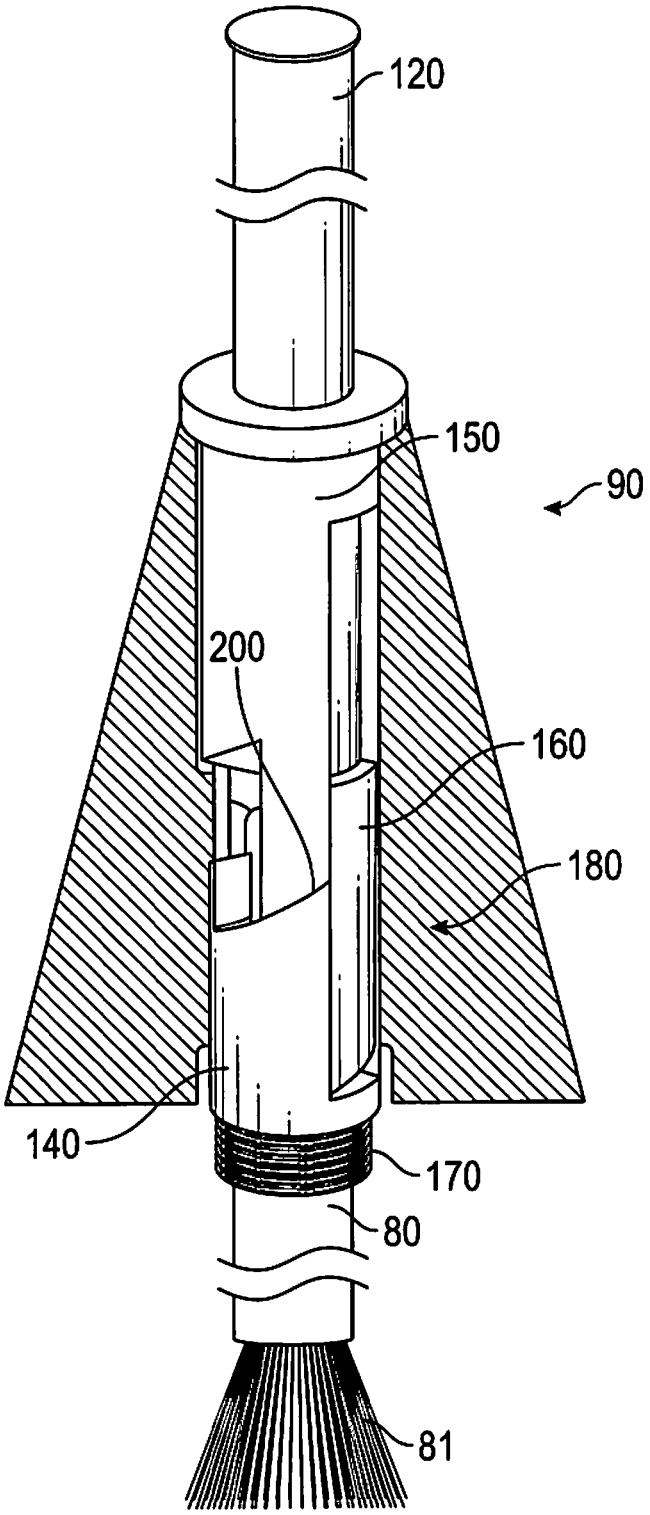
FIG. 3A is a diagram of a brush extension mechanism of the cap, the brush extension mechanism and brush in a retracted position.
Figure 3B:
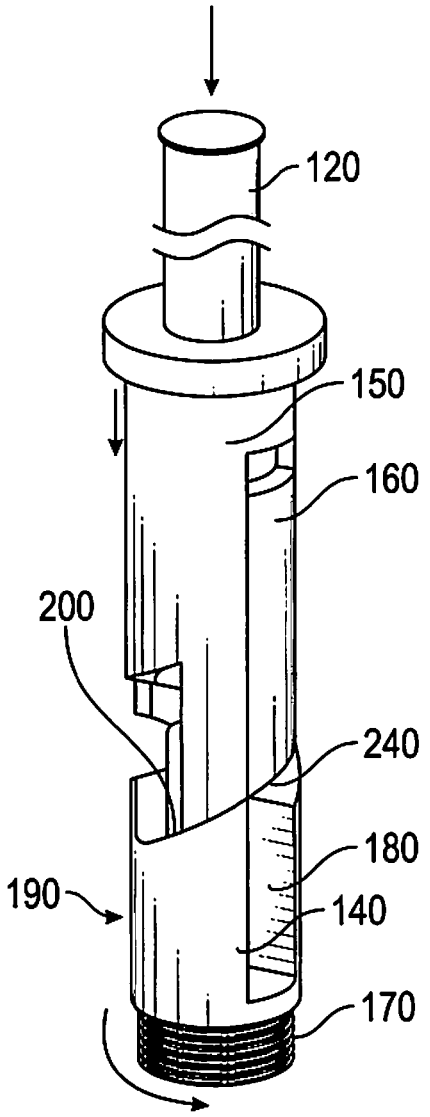
FIG. 3B is a diagram of the brush extension mechanism of the cap showing an actuator and plunger being depressed to push a cam body downwardly to clear a stop member, portions of the cap and brush omitted for clarity of illustration.
Figure 3C:
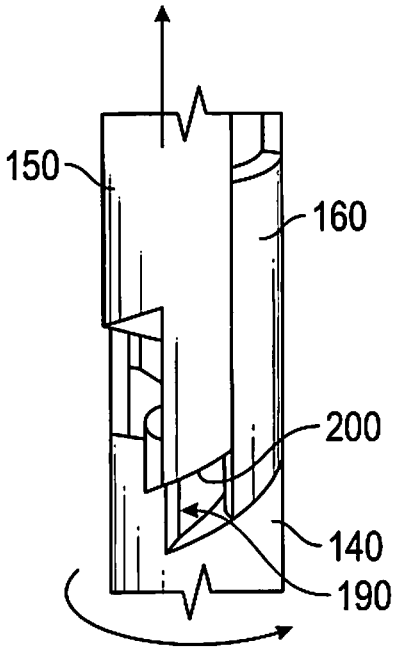
FIG. 3C is a diagram of the plunger being retracted to allow a cam body to rotate to engage the stop member in a short stop member channel of the cam body, portions of the cap and brush omitted for clarity of illustration.
Figure 3D:
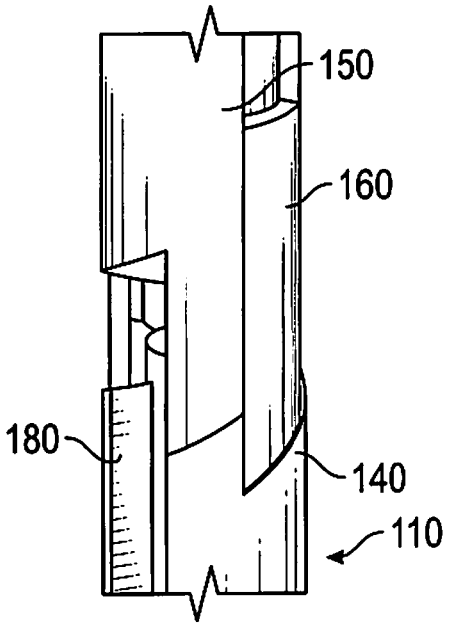
FIG. 3D is a diagram of the brush extension mechanism of the cap shown in an extended position, portions of the cap and brush omitted for clarity of illustration.
Figure 3E:
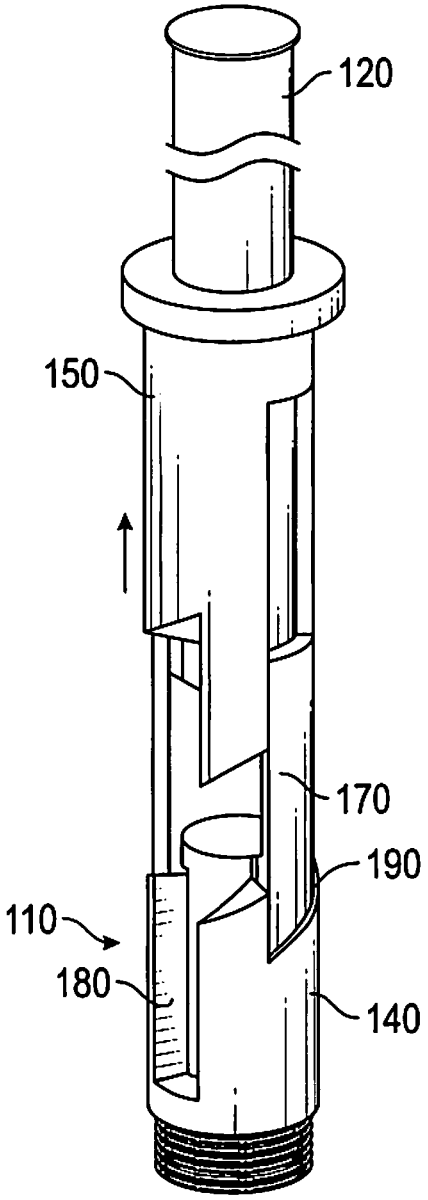
FIG. 3E is an alternate diagram of the brush extension mechanism of the cap shown in the extended position, portions of the cap and brush omitted for clarity of illustration.

FIGS. 1 and 2 illustrate a combination container and applicator 10 for a fluid 15, such as nail polish, paint, or any other fluid that is typically applied with a brush or tool.

A container 20 has a top end 28 open to an internal volume 30 that has a tapered floor 40 for pooling the fluid in a central location 50 on the floor 40 opposite the open top end 28. In a normal orientation, the top end 28 is oriented upward and the floor 40 is oriented downward, so that fluid flows towards the central location 50 of the floor 40. Preferably the container is a rigid material such as glass, plastic, ceramic, metal, or the like.

A cap 60 is adapted to engage the open top end 28 of the container 20 in a sealed and closed configuration 70. Preferably the cap 60 includes internal threads that engage external threads of the top end 28. Other closure mechanisms, however, could also be used.

Figure 4:
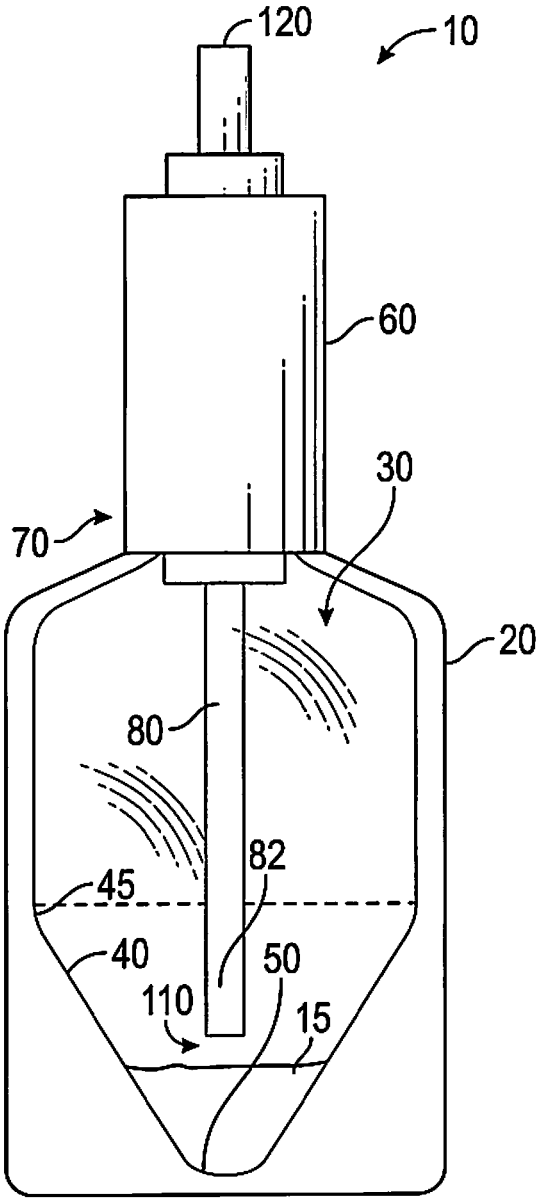
FIG. 4 is a front elevational view of the invention, partially broken away to illustrate the brush and brush actuator in the retracted position and the cap fully engaged with the container in a sealed and closed configuration.

The cap 60 has a brush applicator 80 projecting downwardly therefrom into the internal volume 30 of the container 20 when the cap 60 is in the sealed and closed configuration 70 (FIG. 1). The brush applicator 80 preferably includes a brush 81 and a sheath 82, the brush 81 extending beyond the sheath 82 when the brush applicator 80 is in the extended position 110 (FIGS. 1 and 2), and the brush retracting fully inside the sheath 82 when the brush applicator 80 is in the retracted position 100 (FIG. 4). In the retracted position 100 the brush 81 is shaped by the sheath 82 and prevented from contacting the floor 40 so as to maintain a proper, tight shape of the brush 81, thereby inhibiting the bristles (not shown) of the brush 81 from becoming splayed.

The brush applicator 80 and the cap 60 may be selectively removed from the container 20 by unscrewing (or otherwise disengaging) the cap 60 from the top end 28 of the container 20 and pulling the cap 60 away from the container 20. Typically, the fluid 15 retained by the brush 81 is then applied to a workpiece (not shown), such as a person's fingernails, an object to be painted or cleaned, or the like. When more of the fluid 15 is required, the brush applicator 80 is inserted into the top end 28 of the container 20 so that the brush 81 can be swept around the floor 40 of the container manually to collect more fluid 15 from all parts of the floor 40.

The cap 60 includes a brush extension mechanism 90 that is adapted to move the brush applicator 80 between a retracted portion 100, such that the brush applicator does not contact the floor 40 of the container 20 when the cap 60 is in the sealed and closed configuration 70, and an extended position 110 such that the brush applicator 80 is able to reach all areas and corners 45 of the floor 40 of the container 20 when the cap 60 is contacting the open top end 28 of the container 20 but is not necessarily in the sealed and closed configuration 70.

The brush extension mechanism 90 further includes an actuator 120 projecting through the cap 60 that is adapted to toggle the brush applicator between the extended position 110 and the retracted position 90. Similar to the toggle mechanism in U.S. Pat. No. 3,205,863 to Rhoades on Sep. 14, 1965 (incorporated herein by reference), the brush extension mechanism 90 further includes a cam body 140 (FIGS. 3A-3E) fixed with the brush 81 and the brush actuator 80, a plunger 150 fixed with the actuator 120, at least one stop member 160 fixed within the brush extension mechanism 90 and fixed immovably with respect to the cap 60, and a spring 170 urging the cam body 140 upwardly against the plunger 150 and the at least one stop member 160 when in the retracted position 100 and when the at least one stop member 160 is fully seated in a long stop member channel 180 of the cam body 140. The actuator 120 causes the plunger 150 to press against the cam body 140 and spring 170 until the cam body 140 passes the at least one stop member 160. The cam body 140 and plunger 150 each have multiple angled and abutting surfaces 200 that cause the cam body 140 to rotate upon passing the at least one stop member 160 at the urging of the spring 170. As such, the cam body 140 advances so that the at least one stop member 160 can engage a short stop member channel 190 of the cam body to place the cam body 140, the brush applicator 80, and the brush 81 in the extended position 110. The next press of the actuator 120 causes the plunger 150 to press downwardly again on the cam body 140 so that it clears the at least one stop member 160 and advances so that the long stop member channel 180 of the cam body 140 again becomes engaged with the at least one stop member 160 in the retracted position 100. Each successive press of the actuator 120 causes the brush applicator 80, brush 81, and cam body 140 to toggle between the retracted and extended positions 100,110. A second spring (not shown) may be included to urge the plunger 150 upwardly when released by the user.

The brush extension mechanism 90 described above has a one-to-one ratio of movement between the brush 81 and the actuator 120. However, other brush extension mechanisms 90 could be utilized that provide for a ratio greater than 1 of movement of the brush 81 with respect to the actuator 120, such as a 2:1 ratio of movement of the brush 81 with respect to the actuator 120.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention. The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A combination container and applicator for a fluid, comprising:

a container having a top end open to an internal volume, the internal volume having a tapered floor for pooling the fluid in a central location on the floor opposite the open top end; and a cap adapted to engaged the open top end in a sealed and closed configuration, the cap having a brush applicator projecting downwardly therefrom into the internal volume when the cap is in the sealed and closed configuration, the brush applicator removable from the container when the cap is removed from the container;

the cap including a brush extension mechanism that is adapted to move the brush applicator between a retracted position such that the brush applicator does not contact the floor of the container when the cap is in the sealed and closed configuration, and an extended position such that the brush applicator is able to reach all areas of the floor of the container when the cap is contacting the open top end of the container, the brush extension mechanism including an actuator projecting through the cap that is adapted to toggle the brush applicator between the extended and the retracted positions;

the brush applicator further including a brush and a sheath, the brush extending beyond the sheath when the brush applicator is in the extended position, and the brush retracting fully inside the sheath when the brush applicator is in the retracted position;

the brush extension mechanism including a cam body fixed with the brush, a plunger fixed with the actuator, at least one stop member fixed within the brush extension mechanism, and a spring urging the cam body upwardly against the plunger and the at least one stop member when in the retracted position and when the at least one stop member is fully seated in a long stop member channel of the cam body, the actuator causing the plunger to press against the cam body and spring until the cam body passes the at least one stop member, the cam body and plunger each having multiple angled and abutting surfaces that cause the cam body to rotate upon passing the at least one stop member at the urging of the spring, such that the cam body advances so that the at least one stop member can engage a short stop member channel of the cam body to place the cam body and brush applicator in the extended position, the next press of the actuator causing the cam body to clear the at least one stop member and advance so that the long stop member channel of the cam body again becomes engaged with the at least stop member in the retracted position, each successive press of the actuator causing the brush applicator and cam body to toggle between the retracted and extended positions;

whereby all of the fluid in the container may be reached by the brush applicator when in the extended position, and the brush applicator in the retracted position is able to be stored within the container with the cap in the sealed and closed configuration.

* * * * *